US005771766A

United States Patent [19]

Vedders et al.

[11] Patent Number: 5,771,766

[45] Date of Patent: Jun. 30, 1998

[54] DEVICE FOR CUTTING CHEESE, VEGETABLES, SAUSAGE AND LIKE PRODUCTS INTO SLICES

[75] Inventors: Ronald Ferdinand Vedders, Zoetermeer; Henricus Johannes Gregorius ter Bekke, Epse, both of Netherlands

[73] Assignee: Albert Heijn B.V., Zaandam, Netherlands

[21] Appl. No.: 498,523

[22] Filed: Jul. 5, 1995

[30] Foreign Application Priority Data

Jul. 4, 1994 [NL] Netherlands ..... 9401117

[51] Int. Cl.[6] ..... B26D 7/01

[52] U.S. Cl. ..... 83/241; 83/268; 83/395; 83/468.7

[58] Field of Search ..... 83/468.7, 268, 83/263, 269, 241, 394, 395, 247

[56] References Cited

U.S. PATENT DOCUMENTS

| | | | |
|---|---|---|---|
| 181,367 | 8/1876 | Smith et al. | 83/268 |
| 811,174 | 1/1906 | Rice | 83/468.7 |
| 1,442,205 | 1/1923 | Winkley | 83/268 |
| 1,589,030 | 6/1926 | Whiting | 83/468.7 |
| 2,347,818 | 5/1944 | Folk | 83/268 |
| 2,350,540 | 6/1944 | Spiller et al. | 83/468.7 |
| 2,495,394 | 1/1950 | Teskey . | |
| 2,518,076 | 8/1950 | Scherig . | |
| 2,599,591 | 6/1952 | Spiller et al. | 83/468.7 |
| 2,608,254 | 8/1952 | McLaughlin | 164/52 |
| 2,641,845 | 6/1953 | Gundlach | 33/76 |
| 3,738,504 | 6/1973 | Vail et al. | 83/468.7 |
| 3,926,081 | 12/1975 | Roberts | 83/268 |
| 4,038,892 | 8/1977 | Popeil | 83/4 |
| 4,747,212 | 5/1988 | Cavdek | 30/92 |

FOREIGN PATENT DOCUMENTS

| | | |
|---|---|---|
| A 0 247 364 | 12/1987 | European Pat. Off. . |
| A-0 429 838 | 6/1991 | European Pat. Off. . |
| A-0 434 853 | 6/1991 | European Pat. Off. . |
| A 412 316 | 7/1910 | France . |
| A-828.429 | 5/1938 | France . |
| A 1 043 237 | 11/1953 | France . |
| A-2 556 640 | 6/1985 | France . |
| C-90609 | 5/1896 | Germany . |
| C 418 651 | 9/1925 | Germany . |
| C-454 454 | 12/1927 | Germany . |
| C-663 829 | 7/1938 | Germany . |
| C 683 224 | 10/1939 | Germany . |
| C 923 622 | 7/1954 | Germany . |
| B-1 241 574 | 6/1967 | Germany . |
| A 25 44 276 | 4/1977 | Germany . |
| A 25 50 477 | 5/1977 | Germany . |
| A 25 50 478 | 5/1977 | Germany . |
| A 41 15 632 | 11/1992 | Germany . |
| A 117 521 | 11/1926 | Switzerland . |
| A-309 132 | 11/1955 | Switzerland . |
| 2 279 236 | 1/1995 | United Kingdom . |

OTHER PUBLICATIONS

IBM Technical Disclosure Bulletin vol. 32 No. 3B Aug. 1989, pp. 421–422.

*Primary Examiner*—Kenneth E. Peterson
*Assistant Examiner*—Sean A. Pryor
*Attorney, Agent, or Firm*—Pennie & Edmonds LLP

[57] ABSTRACT

A device for cutting cheese, vegetables, sausage and like products, into slices, comprising a supporting surface for the product to be cut and a knife, wherein adjacent an end edge of the supporting surface a stop plate for the product to be cut is arranged, extending transversely to the supporting surface, which stop plate is coupled with an upwardly and downwardly movable knife holder comprising an elongate knife, which knife holder is situated near the upper edge of the stop plate, while the distance between the stop plate and the knife in a direction transverse to the stop plate defines the thickness of the slices to be cut, and an electric motor is provided for effecting the up and down movement of the knife holder.

1 Claim, 5 Drawing Sheets

DEVICE FOR CUTTING CHEESE, VEGETABLES, SAUSAGE AND LIKE PRODUCTS INTO SLICES

This invention relates to a device for cutting cheese, vegetables, sausage and like products into consumption-ready slices, comprising a supporting surface for the product to be cut and a knife.

Cutters of the type to which the invention relates are used, for instance, in cheese stores, supermarkets with a cheese department, etc., for cutting thin slices of cheese.

In known cheese cutters, the cheese must be cut by hand, which is experienced as burdensome and fatiguing for the store personnel. One type of prior art cutter comprises a supporting plate, typically made of marble, and a knife arranged above the supporting plate, pivotally mounted at one end and having a handle at the other. The knife can pivot in a vertical plane and is used to cut thin slices of cheese off a piece of cheese. It has been found that the lever movement which must be performed with the hinging knife leads to an ergonomically unfavorable load of the arm and shoulder of the operating personnel. Even if an (electrically) heated knife is used, so that the knife cuts through the cheese more easily, such a device leads to additional absenteeism.

Another drawback of the known cutter with a pivoting knife is that the thickness of the slices cannot be set very accurately. Further, there is a real chance of the hands being injured by the knife.

A cutter of the above-described type, though designed for cutting bread, is disclosed in FR-A-412316. This known machine suffers from the above-mentioned drawbacks.

German Patent 683224 discloses a cheese cutter comprising a manually operable knife fitted with a handle, which knife at the two ends thereof can be moved up and down along guide strips extending upwards from the-cheese supporting surface. In this known device the operation of the knife is even more objectionable than in the above-described devices known from practice, where the knife is pivotally mounted at one end and the drawbacks inherent to those devices known from practice also apply to the device known from German Patent 683224.

In the past it has been attempted to obviate the problems outlined above by the use of a cutter with a revolving knife, as sometimes used-for cutting luncheon meat. However, a drawback of such a device is that the revolving knife is actually too thick to be able to cut slices of cheese in the proper manner. Also, cheese traditionally has a different shape from luncheon meats, so that the existing machines with a revolving knife are not very suitable for use as cheese cutters.

The object of the invention is to provide an improved cutter which is particularly suitable for cutting consumption-ready thin slices of cheese in a store or the like and which does not burden the store personnel in an ergonomically unfavorable sense, and is simply, accurately and safely operable. Preferably, the cutter according to the invention should also be suitable for cutting other products, such as for instance vegetables, particular kinds of sausage and the like.

According to the invention, a cutter for cutting cheese and the like into thin slices is characterized in that adjacent an end edge of the supporting surface a stop plate for the product to be cut is arranged, extending transversely to the supporting surface, which stop plate is coupled with an upwardly and downwardly movable knife holder comprising an elongate knife, which knife holder is situated near the upper edge of the stop plate, while the distance between the stop plate and the knife in a direction transverse to the stop plate defines the thickness of the slices to be cut, and an electric motor is provided for effecting the up-and-down movement of the knife holder.

It is noted that DE-A-2550477 and DE-A-2550478 disclose cutting machines with a hydraulically or pneumatically driven knife moving up and down. However, these known cutting machines are intended for use as production machines in a meat processing plant, where frozen pieces of meat are to be cut into smaller pieces to be subsequently processed, for instance into minced meat. Accordingly, the knife of these known machines cuts during the upward as well as the downward movement. Such machines, however, are not suitable for cutting thin slices of cheese in a store or the like.

Hereinafter the invention will be further described with reference to the accompanying drawings of an exemplary embodiment.

Figure 1:
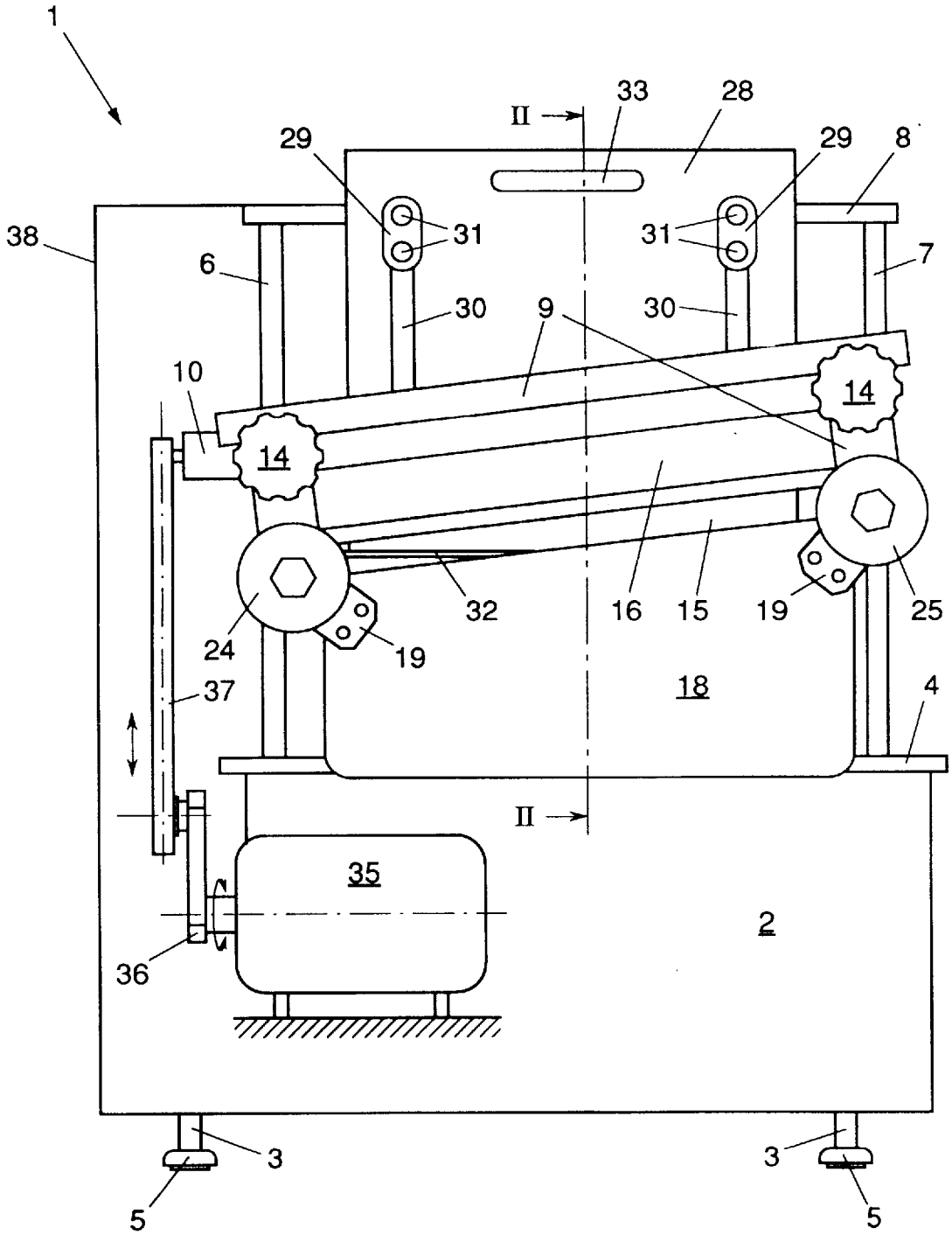
FIG. 1 is a diagrammatic front view with partly cutaway parts of an exemplary embodiment of a cutter according to the invention.

FIG. 1 diagrammatically shows a front view of an example of an embodiment of a cutter 1 according to the invention. The cutter shown comprises a boxlike housing 2 which at the bottom thereof is provided with supporting legs 3 and which at the top thereof carries a supporting surface 4, in this example substantially horizontal, for the products to be cut, such as cheese, but optionally also, for instance, luncheon meats, vegetables and the like. The supporting legs can advantageously be fitted with friction-increasing supporting means 5, such as rubber caps or, for instance, suction cups, so as to prevent displacement of the cutter during use.

Mounted adjacent one of the edges of the supporting surface 4 is a bridge-shaped construction comprising two spaced-apart substantially vertical uprights 6, 7, as well as a connecting girder 8, which connects the free upper ends of the uprights with each other.

Figure 2:
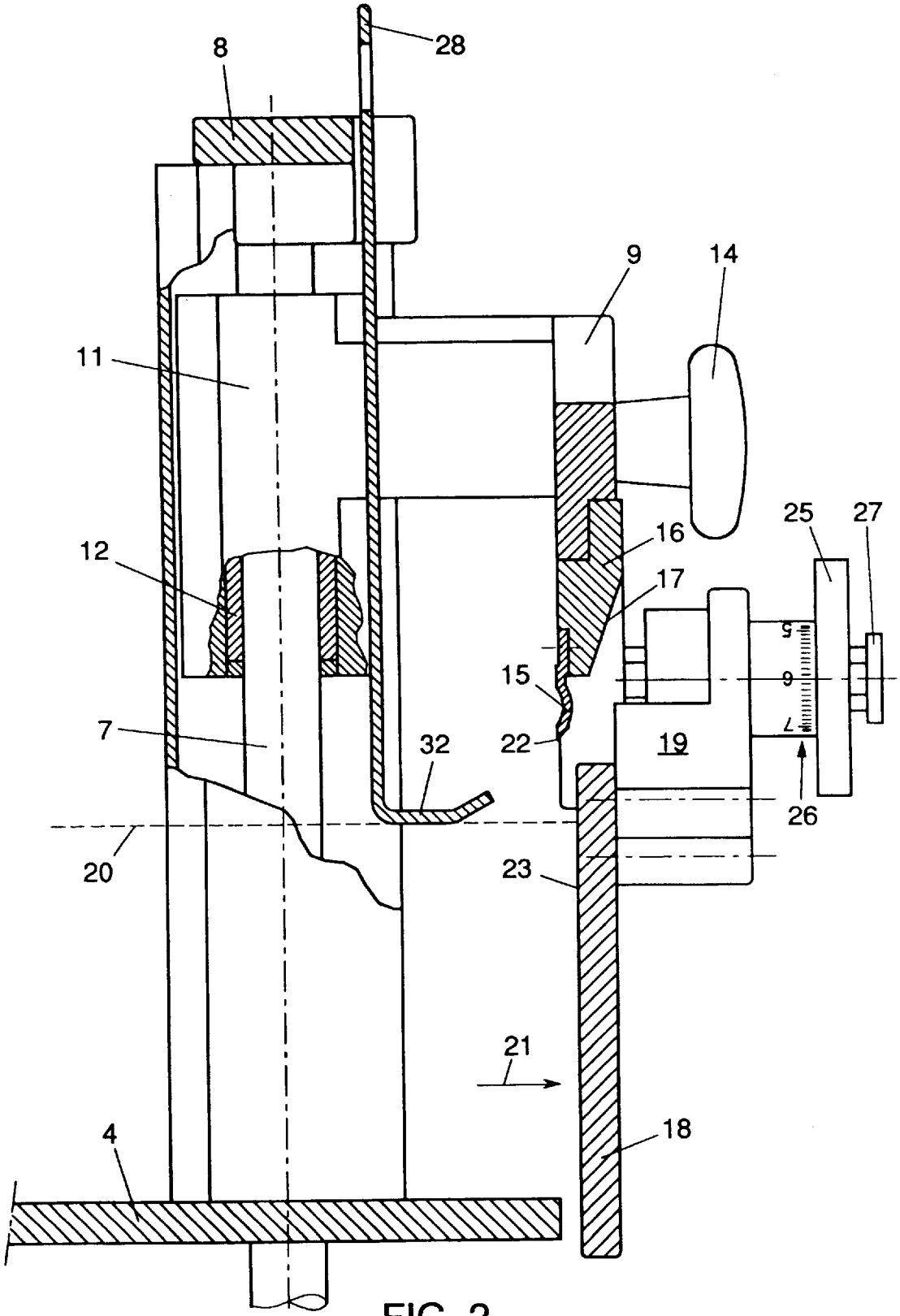
FIG. 2 is a diagrammatic sectional view along the line II—II in FIG. 1.

The uprights 6, 7 constitute guide columns for an upwardly and downwardly movable knife holder 9. To that end, the knife holder comprises two guide blocks 10, 11. In the example shown, the block 10 is coupled to a drive mechanism, as will be further described hereinafter. The guide block 11 is not visible in FIG. 1 but can be seen in FIG. 2. As shown in FIG. 2, in this example the guide blocks are provided with a slide bearing 12. In the example shown, the knife holder is secured by means of manually operable screw knobs 14. By virtue of this construction, the knife holder can be removed without using tools if it is desired to clean, service or replace the knife 15.

As can be seen most clearly in FIG. 2, the knife itself is mounted on a mounting strip 16 comprising a guiding surface 17 tapering downwards towards the knife, guiding the cut slices in such a manner that they can be received outside the cutter.

Figure 4:
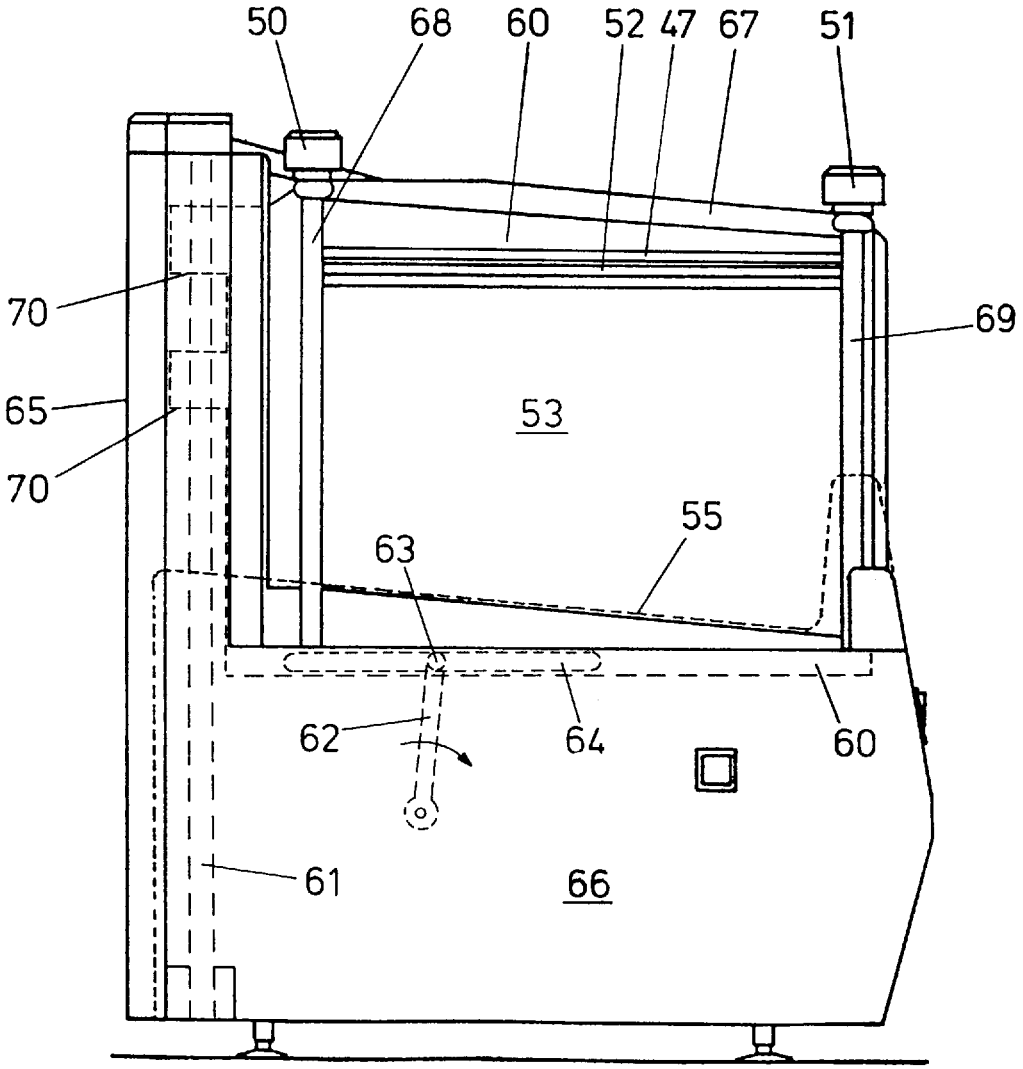
FIGS. 4, 5 and 6 diagrammatically show, respectively, a front view, a side view and a top plan view of another exemplary embodiment of a cutter according to the invention.

With advantage, as shown in FIG. 1, the knife 15 can extend at a slant relative to the cutting direction. Thus the force required for the initial cut is reduced and so are the chances of deformation or damage of the product. The same effect can be achieved if the knife extends perpendicularly to the cutting direction while the supporting surface for the products to be cut is slightly inclined, as shown in FIG. 4.

Arranged under the knife is a stop plate 18 which is mounted on the knife holder via mounting brackets 19. During cutting, the product to be cut is pushed against the stop plate by hand or with a press-on element, not shown. In FIG. 2 a piece of cheese 20 to be cut is represented diagrammatically by broken lines and the press-on direction is indicated by an arrow 21.

In FIG. 2 it is clear to see that the distance between the cutting edge 22 of the knife and the stop face 23 of the stop plate proximal to the product defines the thickness of the slices to be cut. The thickness of the slices to be cut is adjustable. Preferably, adjustment of the thickness is stepless. To that end, the device shown comprises an adjusting mechanism comprising two adjusting knobs 24, 25. The adjusting knobs are manually operable for setting the position of the stop plate relative to the knife holder 9. The adjusting knobs are preferably provided with a scale indicating the thickness of the slices to be cut, as shown in FIG. 2 at 26. The adjusting knobs are disc-shaped and comprise a central bore provided with screw thread and cooperating with a threaded rod 27 connected to the knife holder. The threaded rods reach through bores in the mounting brackets 19. In a practical embodiment, the thickness of the slices can for instance be infinitely variable between 0 and about 10 mm.

The construction of the adjusting mechanism is preferably so designed that the slice thickness at one end of the knife can be different from the slice thickness at the other end of the knife. In this way slightly wedge-shaped slices can be cut. This provision makes it possible, for instance, for quarter pieces of cheese cut from a round cheese to be uniformly cut into slices of the same size. Also, any residual piece of cheese then obtained has the usual sector or wedge shape and can be sold as (packaged) cheese in one piece.

In the example shown, the wedge shape of the slices can simply be obtained by giving the adjusting knobs on opposite ends of the knife holder slightly different settings, so that the knife and the stop plate come to lie in planes that are not parallel but, viewed in the horizontal plane, diverge slightly in the direction of the circular side of the cheese.

Preferably, means are provided for heating the knife electrically, because some products are easier to cut with a heated knife. To that end, for instance by means of connecting wires (not shown), an electrical current can be passed through the knife, or an electrical heating element, depicted diagrammatically in FIG. 4 at 47, can be arranged alongside the knife.

To protect the hands of the operating personnel, a vertical safety plate 28 is arranged, which is connected to the connecting girder 8 and which can be moved up and down relative to the girder. To that end, in this example the plate is mounted by means of two mounting plates 29 and bolts 31 extending through the mounting plates and vertical slots 30 in the safety plate. In operation the safety plate 28 has its lower edge bearing on the product to be cut. Thus the plate shields the space between the guide columns 6, 7, so that the knife is not accessible from the product supply side since the space under the plate 28 is occupied by the product.

Under the influence of its own weight, if desired supplemented with a small spring bias, the safety plate bears on the top of the product to be cut. In the example shown, the safety plate has a flanged lower edge 32. Further, in this example the safety plate comprises a handle 33 for pulling the plate up.

In operation the knife with the stop plate moves up and down until the desired number of slices have been cut off. The slices are guided outwards via the gap between the knife and the stop plate. In the example shown the knife, viewed in vertical cross-section, is slightly convex, so that the outward movement of the slices is initiated directly upon cutting. This movement is then guided further by the guiding surface 17.

During cutting, the product to be cut lies still against the stop plate and on the supporting surface. So the product need not be moved back and forth, as is the case, for instance, in the known devices with a revolving knife, and this is an advantage from an ergonomic point of view.

The up and down movement of the knife could be obtained by means of a manually operable crank mechanism, but preferably, as shown, use is made of motor drive. In the example shown, an electric motor 35 is employed, which is mounted under the supporting surface in the housing and which drives a projection of the knife holder via suitable transmission means, in this example a crank mechanism with a crank disk 36 and a crank arm 37. Preferably, the projection is one of the guide blocks 10 or 11. The crank mechanism is arranged in a box 38.

Other methods of drive and/or transmitting the drive power are conceivable. To be mentioned as an example is a drive by means of a rotary threaded spindle which cooperates with screw thread in a bore provided in a guide block, or in an element connected with the guide block. It is also possible to drive both guide blocks.

Further, if desired, it is possible to rotate the device through 90 degrees, so that the device shown in FIG. 1 lies, as it were, on its right or left side.

Figure 3:
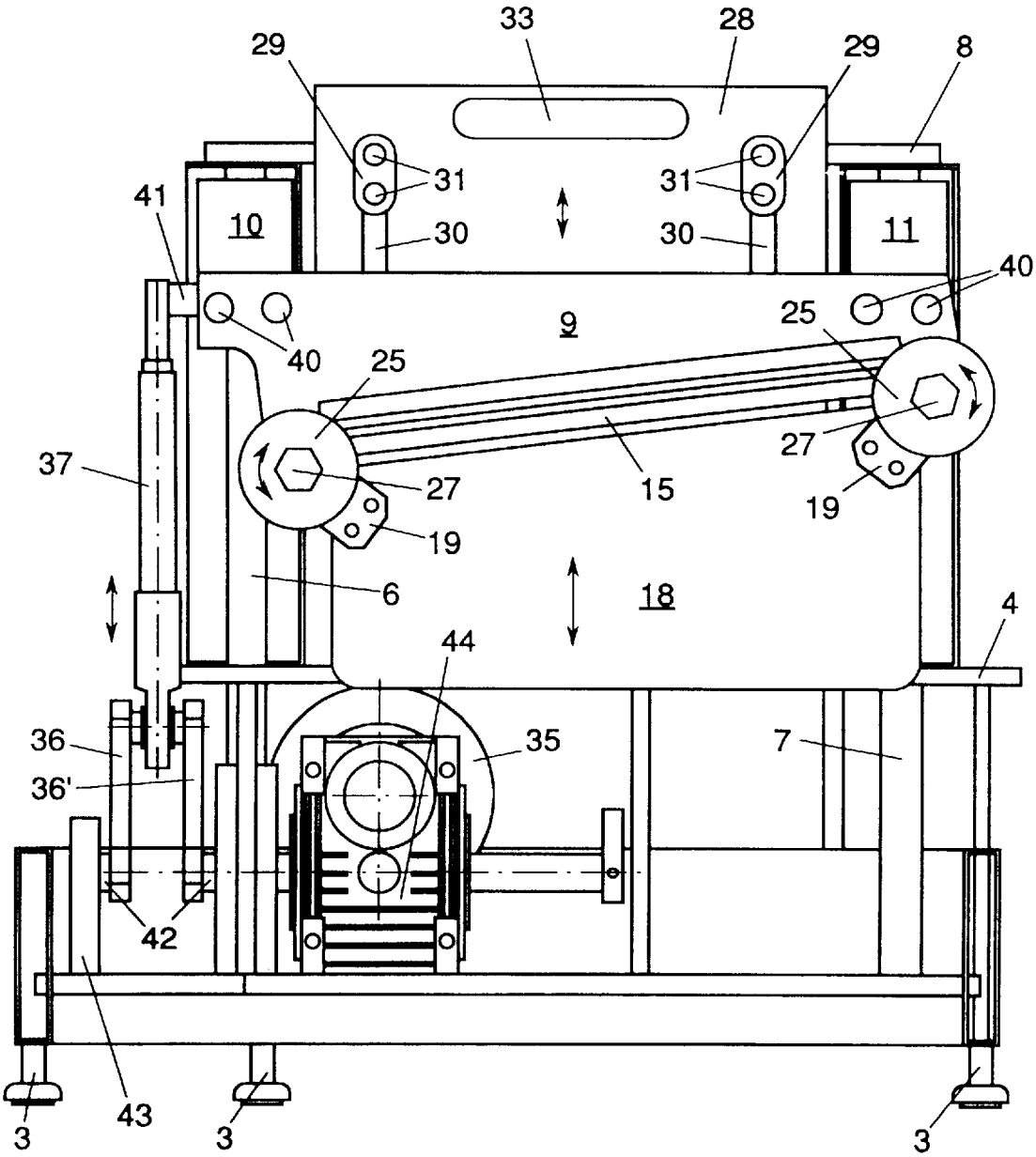
FIG. 3 is a diagrammatic front view of an example of a variant of the device shown in FIGS. 1 and 2.

FIG. 3 shows, by way of example, another variant of a device according to the invention. In the exemplary embodiment of FIG. 3 the knife 15 is again mounted in a knife holder 9 in turn mounted on the guide blocks 10, 11, however, not by means of screw knobs but by means of screw bolts 40. In the example shown, one guide block 10 is again coupled with a crank arm or connecting rod 37 via a pin 41. The connecting rod can rotate about the pin 41. The other end of the connecting rod is rotatably mounted between two crank cheeks 36, 36'. The crank cheeks are bearing-mounted in fixed supports 43 through main shafts 42. One main shaft 42 is driven by a motor 35 through a right-angled transmission 44.

Figure 5:
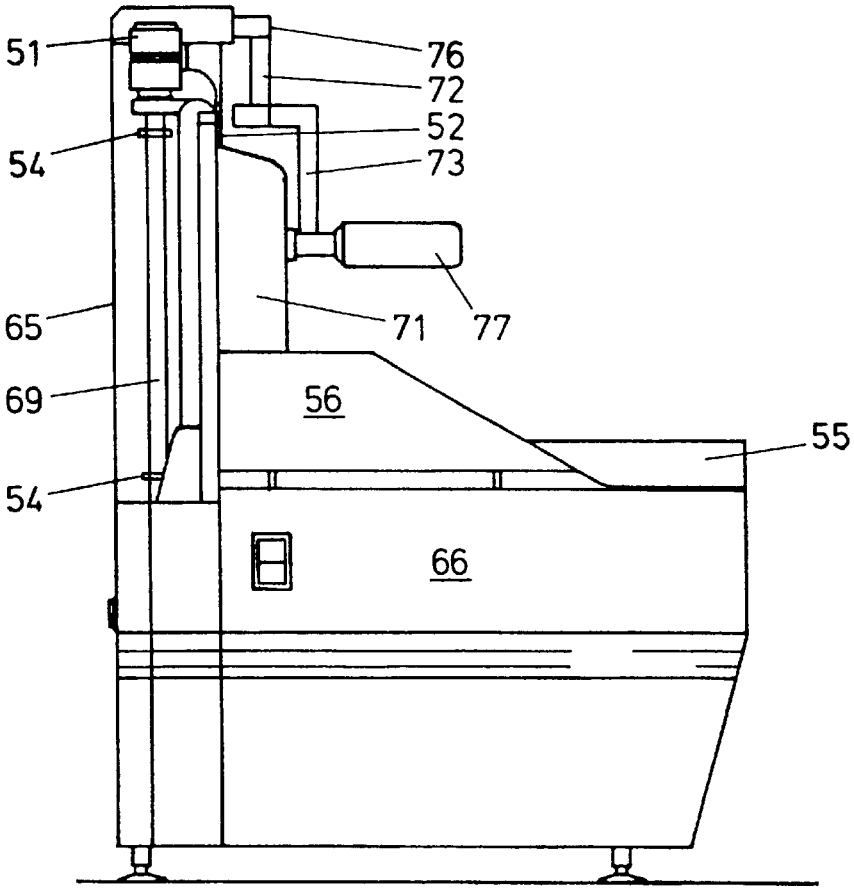
Figure 6:
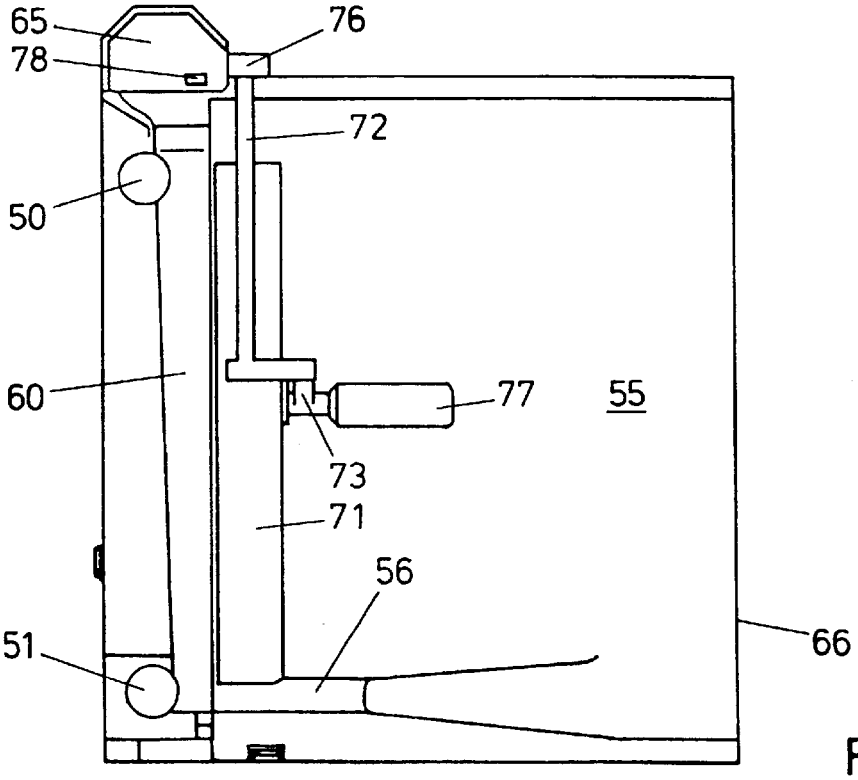

FIGS. 4, 5 and 6 diagrammatically show a front view, a side view and a top plan view of another exemplary embodiment of a device according to the invention. The exemplary embodiment shown in FIGS. 4–6 deviates from the exemplary embodiment shown in FIGS. 1–3 in that the stationary connecting girder 8 of FIGS. 1–3 and the stationary uprights 6, 7 have been replaced by an upwardly and downwardly movable frame 60, which on one side thereof is mounted self-supportingly on a stationary vertical guide, for instance a bar or tube 61, as indicated by broken lines in FIG. 4, by means of one or more guide pieces 70 provided with a suitable recess or bore. The frame is driven by an electric motor, not shown, via a crank mechanism with a rotary crank arm 62 which, via a crank pin 63 arranged at the end of the crank arm 62, engages in, for instance, a horizontal slot 64 of the frame. Thus the frame can be set into an up and down movement. The vertical guide tube or bar 61 or the like is located in a column-shaped part 65 of the box 66 of the cutter.

The frame has an upper arm 67 extending transversely of the column-shaped part 65, which arm 67 at the two ends thereof comprises a vertical rod 68, 69. In this example both rods comprise at the top thereof rotary knobs 50, 51, by means of which the position of the knife 52 mounted under the arm 67, and the position of the stop plate 53, likewise mounted under the arm 67 in the frame, are adjustable relative to each other. To that end, the rods may, for instance, comprise one or more eccentric parts or rings or the like, as indicated diagrammatically in FIG. 5 at 54. By means of the adjusting knobs the thickness of the slices to be cut off and also, if desired, the wedge-shape of the slices, can be set.

In the example shown, the position of the knife is approximately horizontal, but the position of the supporting surface 55 is inclined, as can be seen best in FIG. 4. The supporting surface slants down from the side of the column 65 to the side where the operating personnel are normally present, so that the cheese to be cut comes to lie in the proper position against a fixed or, as shown, detachable, stop partition 56 on the side of the operating personnel.

On the side of the frame 60 and the stop plate 53 proximal to the supporting surface, a safety plate is provided again, which is indicated in FIGS. 5 and 6 at 71 and which bears on the product to be cut during use of the cutter. In this example the safety plate is pivotally connected to the column 65, as shown at 76, via an arm made up of a number of pivotally interconnected sections 72, 73. The arm can also be pivotally connected with the safety plate and, if desired, can also be provided with a handle as indicated at 77.

The arm is preferably coupled with a switching means, represented diagrammatically at 78, for instance a microswitch or the like, in such a manner that the power supply to the motor of the cutter is interrupted if the safety plate does not bear on a product to be cut or is in an upwardly pivoted position.

Also in the embodiment according to FIGS. 4–6, the knife 52 is provided with a heating element 47 (see FIG. 4). In this exemplary embodiment the heating element is designed as a strip of foil heating. The use of foil heating is known per se from aircraft construction, where foil heating is used for heating the skin of the aircraft to cause ice deposits to melt.

Surprisingly, foil heating has also been found to be eminently suitable for heating cheese knives. Because the heating element has a very small thickness, it can be arranged close to the cutting edge of the knife, where the need for heating is largest. Thus, while the parts of the knife that are in intensive contact with the cheese during operation are sufficiently heated, any heating of other parts of the device —causing cheese to encrust in the course of time— can be limited. The foil has a large area of contact with the knife, so that a sufficiently large heat transfer to the knife can be achieved with a small difference in temperature. This provides the advantage that, firstly, in the area where the cheese is being cut, no parts are present whose surface temperature is so high that cheese being in contact with those parts would melt and, secondly, upon switching on the heating, the knife heats up rapidly to the operating temperature and an accurate, fast-reacting thermostatic control is possible, so that after the knife has cooled due to the cutting of cold cheese the intended temperature (42°–45°) is rapidly regained again.

It is observed that after the foregoing, various modifications will readily occur to those skilled in the art. Such modifications are understood to fall within the scope of the invention.

We claim:

1. A device for cutting cheese, vegetables, sausage into consumption-ready slices, comprising a supporting surface for the products to be cut and a knife, characterized in that adjacent an end edge of the supporting surface a stop plate for the products to be cut is arranged, extending transversely to the supporting surface, which stop plate is coupled with an upwardly and downwardly movable knife holder comprising an elongate knife, which knife holder is located near an upper edge of the stop plate, while the distance between the stop plate and the knife in a direction transverse to the stop plate defines the thickness of the slices to be cut and is adjustable by means of adjusting means, and that an electric motor is provided for effecting the up and down movement of the knife holder; and further characterized in that the knife holder is arranged in a frame which is self-supportingly mounted for up and down movement on a single substantially vertical stationary guide arranged next to the supporting surface near said end edge, and which frame further carries the stop plate, and in that the frame further carries on opposite sides of the stop plate a vertical rod, individually rotatable by means of a connected to each rod knob, each rod comprising at least one eccentric member for individual adjustment of the distance between the stop plate and the knife in a direction transverse to the stop plate by rotation of either one of said vertical rods about a vertical axis, by way of said knobs; whereby the stop plate is pivoted about a vertical axis.

* * * * *

UNITED STATES PATENT AND TRADEMARK OFFICE

CERTIFICATE OF CORRECTION

PATENT NO. : 5,771,766

DATED : June 30, 1998

INVENTOR(S) : VEDDER et al.

It is certified that error appears in the above-identified patent and that said Letters Patent is hereby corrected as shown below:

TITLE PAGE, (Heading), "Vedders et al." should read --Vedder et al.--;

TITLE PAGE, [75] Inventors: "Vedders," should be --Vedder,--.

Signed and Sealed this

Thirteenth Day of October 1998

*Attest:*

Bruce Lehman

BRUCE LEHMAN

*Attesting Officer*

*Commissioner of Patents and Trademarks*